US005943658A

United States Patent [19]

Gravell et al.

[11] Patent Number: 5,943,658

[45] Date of Patent: Aug. 24, 1999

[54] METHOD FOR AUTOMATIC DETERMINATION OF ORIGINATION ZIP CODE USING CALLER I.D.

[75] Inventors: Linda V. Gravell, Guilford; Frederick W. Ryan, Jr., Oxford, both of Conn.

[73] Assignee: Pitney Bowes Inc., Stamford, Conn.

[21] Appl. No.: 08/775,818

[22] Filed: Dec. 31, 1996

[51] Int. Cl.[6] ..... G07B 17/00

[52] U.S. Cl. ..... 705/410; 235/385; 364/400

[58] Field of Search ..... 235/375, 380; 364/400, 479.01, 479.02, 479.05; 705/400, 401, 410

[56] References Cited

U.S. PATENT DOCUMENTS

| | | | |
|---|---|---|---|
| 4,024,380 | 5/1977 | Gunn | 235/432 |
| 5,097,528 | 3/1992 | Gursahaney et al. | 379/67 |
| 5,265,145 | 11/1993 | Lim | 379/88 |
| 5,311,577 | 5/1994 | Madrid et al. | 379/93 |
| 5,341,414 | 8/1994 | Popke | 379/142 |
| 5,343,516 | 8/1994 | Callele et al. | 379/98 |
| 5,394,461 | 2/1995 | Garland | 379/106 |
| 5,694,458 | 12/1997 | Okada et al. | 379/100.08 |

FOREIGN PATENT DOCUMENTS 0 665 517 1/1995 European Pat. Off. .

*Primary Examiner*—Edward R. Cosimano
*Attorney, Agent, or Firm*—Charles R. Malandra, Jr.; Melvin J. Scolnick

[57] ABSTRACT

A method is provided for determining origin ZIP code for a postage meter. The method includes receiving at a data center a call that originates from the location of the postage meter. Using caller ID, the data center determines the phone number originating the call. The data center also determines the identification of the postage meter. If the phone number has changed from a phone number from the previous phone call for the postage meter, the data center obtains a five-digit ZIP code for the address corresponding to the phone number. If the five-digit ZIP code has changed from a previous ZIP code used for postal accounting during previous transactions for the postage meter, the data center obtains a new certificate based on the five-digit ZIP code and downloads the new certificate to the postage meter. The data center transfers postage meter register values to a new postal account for the new certificate.

13 Claims, 2 Drawing Sheets

METHOD FOR AUTOMATIC DETERMINATION OF ORIGINATION ZIP CODE USING CALLER I.D.

FIELD OF THE INVENTION

The present invention relates to postage metering systems and more particularly to accounting for postage printed by postage metering systems.

BACKGROUND OF THE INVENTION

The Information-Based Indicia Program (IBIP) is a distributed trusted system proposed by the United States Postal Service (USPS). The IBIP is expected to support new methods of applying postage in addition to, and eventually in lieu of, the current approach, which typically relies on a postage meter to mechanically print indicia on mailpieces. The IBIP requires printing large, high density, two dimensional (2-D) bar codes on mailpieces. The Postal Service expects the IBIP to provide cost-effective assurance of postage payment for each mailpiece processed.

The USPS has published draft specifications for the IBIP. The INFORMATION BASED INDICIA PROGRAM (IBIP) INDICIUM SPECIFICATION, dated Jun. 13, 1996, defines the proposed requirements for a new indicium that will be applied to mail being processed using the IBIP. The INFORMATION BASED INDICIA PROGRAM POSTAL SECURITY DEVICE SPECIFICATION, dated Jun. 13, 1996, defines the proposed requirements for a Postal Security Device (PSD) that will provide security services to support the creation of a new "information based" postage postmark or indicium that will be applied to mail being processed using the IBIP. The INFORMATION BASED INDICIA PROGRAM HOST SYSTEM SPECIFICATION, dated Oct. 9, 1996, defines the proposed requirements for a host system element of the IBIP. The specifications are collectively referred to herein as the "IBIP Specifications". The IBIP includes interfacing user (customer), postal and vendor infrastructures which are the system elements of the program.

The user infrastructure, which resides at the user's site, comprises a postage security device (PSD) coupled to a host system. The PSD is a secure processor-based accounting device that dispenses and accounts for postal value stored therein. The host system (Host) may be a personal computer (PC) or a meter-based host processor.

It is expected that once the IBIP is launched, in particular when PC-based meters are introduced, the volume of active meters will increase significantly. Such volume increase is expected to occur predominately in the small office and home office (SOHO) market. This will result in a new class of postage meter users that are not familiar with the USPS postal regulations that are set forth in the Domestic Mail Manual, commonly referred to as the DMM. Such regulations include the initial determination of an accountable or licensing ZIP code and the responsibility of a meter user to notify the USPS or the meter vendor whenever a meter is relocated.

Under conventional postage evidencing infrastructure, communications have been point to point, with limited, meter specific information transmitted to and from conventional meters. Under the IBIP, postage metering is evolving in a manner consistent with new communications technology, such as networked computer systems, internet, cellular communications and the like. Thus, IBIP meters, and in particular PC meters, are easily moved to any geographic location within the United States. Such movement of meters is regulated by the USPS.

Evidence of postage payment and funds distribution to licensing post offices depend on the accurate tracking of the meter location and registration to a licensing post office postal code. For conventional mechanical and electronic meters the USPS accounts for metered mail by origin ZIP code. Such conventional meters have been tied to a small deposit area of a local licensing post office. However, for a PC meter, the host PC and PSD can easily be moved from one location to another. The DMM sets forth the responsibility of the meter customer to inform the PSD vendor, such as the assignee of the present invention, or the USPS that the move has occurred and the identity of the new location of use. Since a PC meter is an open system, i.e., is not dedicated to performing only postage metering, that is easily transportable, the user may be unaware of or may not remember the USPS regulations governing such relocation. It is likely that the USPS will continue to accept and process mail from such SOHO PC meter users even though they may no longer reside in the licensing post office area. Thus, it is likely that over time, the list of meters and associated licensing post offices will become inaccurate, resulting in incorrect funds distribution to such licensing post offices.

Lost and stolen meters are a continuing problem for both postage meter vendors and the USPS. While some of these losses are a direct result of fraudulent activity, it is believed that many are due to procedural oversights by, for example, a customer (relocation, sale of a business, incorrect address on a form, database mismatches, etc.). As a result, some meters listed as lost or stolen may be refilled via contact with the Vendor Data Center. Other postage meters may be denied refills because they appear on a lost and stolen meter list.

SUMMARY OF THE INVENTION

The present invention resolves conflicts between a meter's address and a licensing post office. It has been found that the relocation of PC meters may be detected and updated by checking the phone number from which a PC meter connects to the vendor infrastructure. By combining the caller ID feature of ordinary telephone service with national telephone directories and other databases the approximate location of a postage meter can be determined during contact with the Vendor Data Center, for example for meter refill. In this manner the present invention improves the USPS accounting of postage metering by determining the origination ZIP code for the meter even though the meter may have been relocated from the postal zone corresponding to its licensing post office. An additional benefit of the present invention is that it can be used to track lost or stolen postage meters.

When a mailpiece is prepared and then mailed, there are four addresses of concern to the USPS: the destination address, the user home/office address, the submission address and the return address.

The IBIP requires IBIP meters to contact the vendor infrastructure on a periodic basis. Since the calling telephone number of such contact is available to the vendor infrastructure, via caller ID, it has been found that the address of the IBIP meter can be determined Based upon this address, the licensing, i.e., the accountable, post office for each IBIP meter can be determined.

It has been found that the present invention reduces the chance of rejected mail after a meter move. The present invention provides an indication and support for meter regulation compliance. It has further been found that the present invention provides better tracking of meters within each licensing post office, and an accurate distribution of customer postal funds to the correct licensing post office.

The present invention provides a method for determining origin ZIP code for a postage meter. The method includes receiving at a data center a call that originates from the location of the postage meter. Using caller ID, the data center determines the phone number originating the call. The identification of the postage meter is transmitted from the postage meter to the data center. If the phone number has changed from a phone number from the previous phone call for the postage meter, the data center obtains a five-digit ZIP code for the address corresponding to the phone number. If the five-digit ZIP code has changed from a previous ZIP code used for postal accounting during previous transactions for the postage meter, the data center obtains a new license and a new certificate from the USPS based on the five-digit ZIP code and downloads the new certificate to the postage meter. The data center transfers postage meter register values to the new licensing post office.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
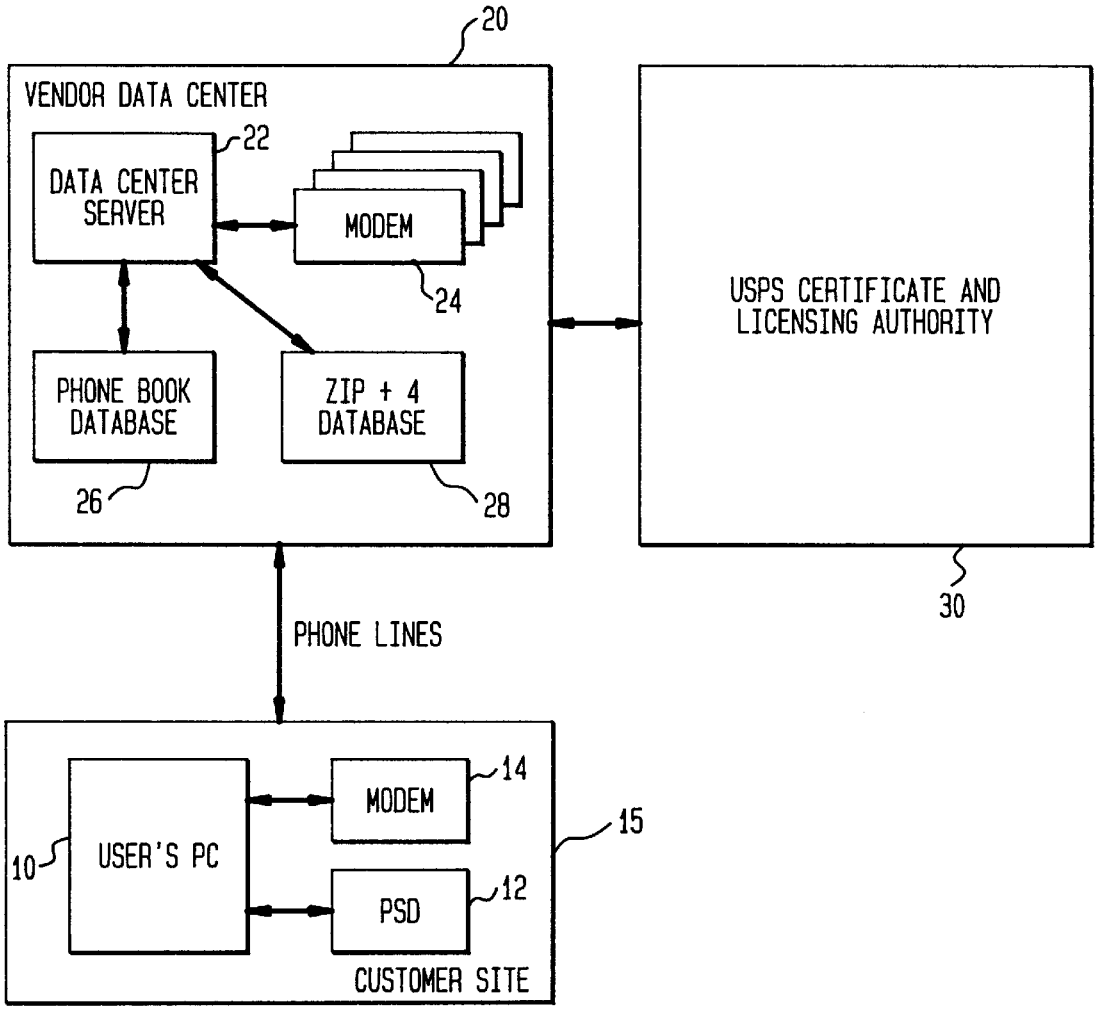
FIG. 1 is a block diagram of a postal system in which the present invention operates.

In describing the present invention, reference is made to the drawings, wherein there is seen in FIG. 1 a postal system in which the present invention operates. A host PC 10, which is located at a customer site 15, is coupled to a PSD 12 and a modem 14. The host PC 10 is a conventional personal computer system, including processor, hard drive, display, keyboard and printer. The host PC 10 is connected, for example, by modem 14 to a Vendor Data Center 20. The Vendor Data Center includes a Data Center Server 22 which is connected to a plurality of modems 24 for communicating to a plurality of PC meters. It will be understood that the communication between the PC meter and Vendor Data Center may be by alternate conventional communication means, such as a network. The Vendor Data Center has access to a Phone Book Database 26 and a ZIP+4 Database 28. The Vendor Data Center also communicates with a USPS Certificate and Licensing Authority 30. A licensing Post Office (not shown) is the Post Office to which PSD is licensed to submit mailpieces in accordance with postal regulations.

Under the PC meter concept of the IBIP, the vault is no longer secured physically within a traditional postage meter. The PC meter vault is a PSD which is a small transportable device that is physically coupled to a standard personal computer which functions as a Host PC. A customer may then access the PSD directly from the Host PC or remotely via a conventional network. Thus, for a PC meter it is easy for a customer to relocate the PSD to another Host PC.

Traditional postage meters are registered to a licensing, i.e., origin, post office for USPS accounting and auditing purposes. As a result, customers who desire to mail from more than one (licensing post office) location must have a meter for each location. This is not a problem for larger businesses, but is impractical for small businesses and individuals who travel frequently (such as traveling sales representatives, consultants, etc.). This invention solves this problem by combining caller ID, national telephone directories and PC metering to enable customers to move a single PC meter from location to location, while satisfying USPS requirements that postage be accounted for by origin of deposit.

When a customer initiates a call to the Vendor Data Center, for example for meter refill or for remote inspection, this is usually via the modem connection over a standard telephone line. The Data Center determines the phone number from which the customer is placing the call using the Caller ID feature that is present in most phone systems. This is usually accomplished by demodulating the data sent between the first and second ring. This data contains the phone number which originated the call and the time of the call (it usually conforms to the Bell 202 or V.23 1200 baud FSK asynchronous data standard).

Figure 2:
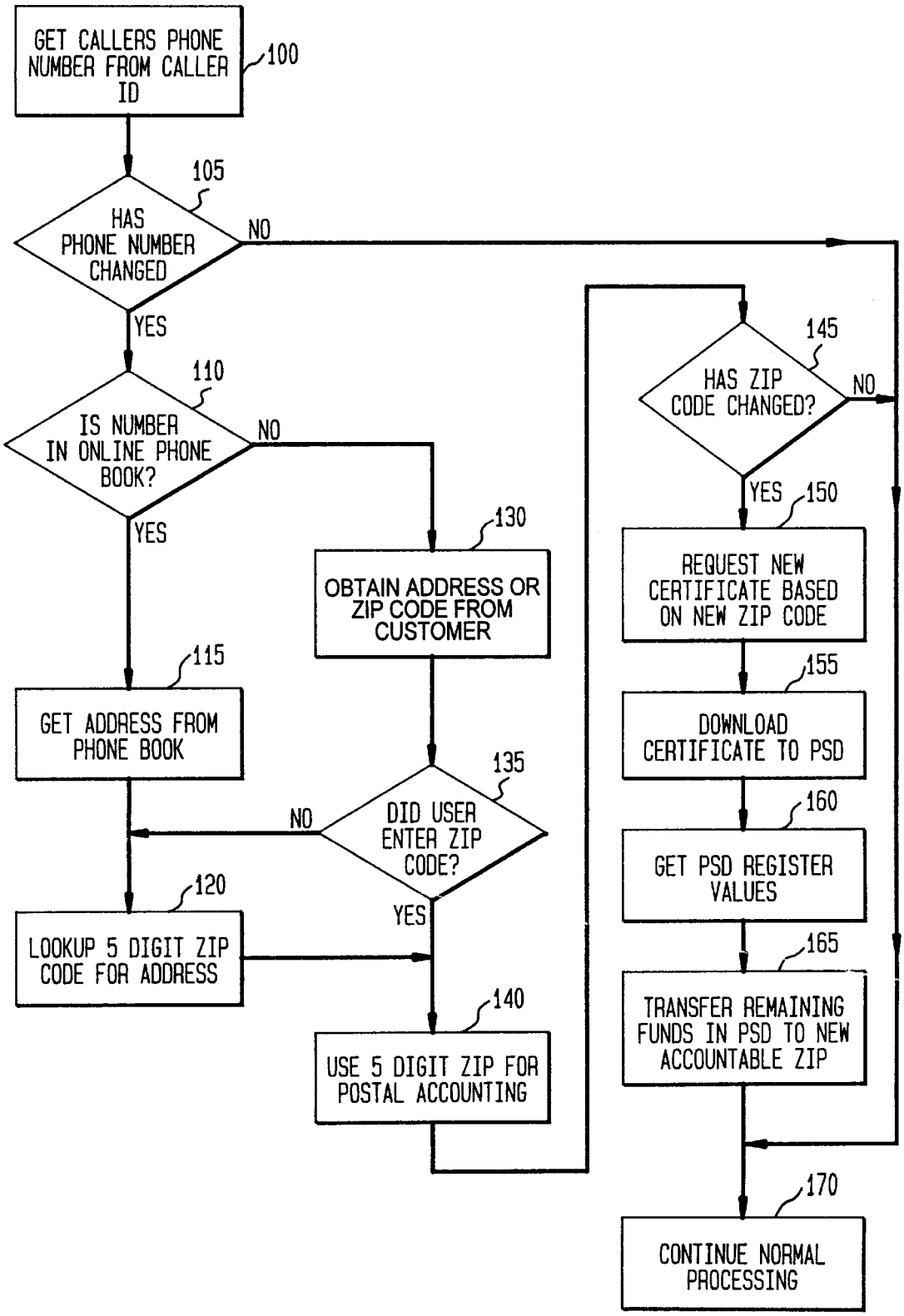
FIG. 2 is a flow chart of the method for automatic determination of an origination ZIP code in accordance with the present invention.

Once the phone number has been determined, a national phone directory (which is currently available on CD-ROM) is used to determine the address from which the call is being placed. After the address has been determined, the ZIP code from which the call originated may be determined by accessing a similar national database of ZIP codes (also currently available on CD-ROM). All subsequent postage issued from the PSD may then be allocated to the appropriate licensing post office or postal zone based upon the ZIP code from which the call originated. FIG. 2 is a flow chart of this procedure.

This same technique may be used for other types of connections (such as the Internet) using appropriate databases (assuming they exist or can be easily created). In addition, this scheme can be used to determine the origin ZIP code for remote registration of any digital meter, such as PostPerfect™ and Personal Post Office™, both manufactured by the assignee of the present invention, or to determine the location of a conventional electronic or mechanical meter connecting for a Postage-by-Phone™ refill or remote inspection.

Referring now to FIG. 2, the process of the present invention is shown. At step 100, the Vendor Data Center has received a call from a PC meter and obtains the PC meter customer's phone number using the Caller ID feature of the telephone system. At step 105, the Vendor Data Center determines if the customer's phone number has changed from the previous call to the Vendor Data Center. If the customer's phone number has not changed, then normal processing is continued at step 170. If the customer's phone number has changed, then, at step 110, the Vendor Data Center determines if the customer's phone number is in the Phone Book Database. If the customer's phone number is in the Database, then, at step 115, the Vendor Data Center obtains from the Phone Book Database a customer mailing address corresponding to the customer's phone number. At step 120, the Vendor Data Center obtains a five-digit ZIP code for the customer mailing address from the ZIP+4 Database. At step 140, the Vendor Data Center uses the five-digit ZIP code for postal accounting.

If, at step 110, the customer's phone number is not in the Database, then, at step 130, the Vendor Data Center queries and obtains an address or ZIP code from the customer. At step 135, the Vendor Data Center determines if the customer entered a ZIP code. If the customer entered a ZIP code, then, at step 140, the Vendor Data Center uses the ZIP code for postal accounting. If the customer did not enter a ZIP code, then, at step 120, the Vendor Data Center obtains a five-digit ZIP code for the customer mailing address from the ZIP+4 Database. At step 140, the Vendor Data Center uses the ZIP code for postal accounting.

At step 145, the Vendor Data Center determines if the ZIP code has changed from the previous call to the Vendor Data Center. If the customer's ZIP code has not changed, then normal processing is continued at step 170. If the customer's ZIP code has changed, then, at step 150, the Vendor Data Center requests and receives from the USPS Certificate and Licensing Authority a new certificate based on the customer's new ZIP code. At step 155, the Vendor Data Center downloads the new certificate to the PSD. At step 160, the Vendor Data Center obtains the register (ascending and descending) values from the PSD. At step 165, the Vendor Data Center transfers funds remaining in the existing customer account, which is based on the previous ZIP code, to a new account based on the new ZIP code. Normal processing continues at step 170.

As previously noted, lost and stolen meters are a continuing problem for both postage meter vendors and the USPS. It has been found that the present invention provides a method for tracking a history of contacts with a particular customer and potentially finding lost and stolen meters.

For example, during a meter refill request a customer contacts the Vendor Data Center using standard telephone lines. The Data Center determines the phone number from which the customer is placing the call using the Caller ID feature. Once the phone number had been determined, a national phone directory (which is currently available on CD-ROM) would be used to determine the address from which the call was placed. Additional databases could also be consulted to arrive at the address (and potentially the individual) from which the refill request originated. This data would then be checked against a number of databases to determine if the meter had been reported as lost or stolen, or the customer had moved without notifying PB or the Post. This process could be carried out in real time or as a post processing step. In addition, it could be applied even if a refill is denied.

While the present invention has been disclosed and described with reference to a single embodiment thereof, it will be apparent, as noted above, that variations and modifications may be made therein. It is, thus, intended in the following claims to cover each variation and modification that falls within the true spirit and scope of the present invention.

PostPerfect™, Personal Post Office™ and Postage-by-Phone™ are trademarks of Pitney Bowes Inc., the assignee of the present invention.

What is claimed is:

1. A method for determining origin ZIP code for a postage meter, the method comprising the steps of:

receiving a communication originating from the location of the postage meter;

obtaining an origin identifier of the originating communication;

obtaining an address corresponding to the origin identifier; and obtaining a five digit ZIP code for the address.

2. The method of claim 1 comprising the further steps of:

obtaining a meter license from the USPS based on the five digit ZIP code.

3. The method of claim 1 wherein the communication is a phone call and the identifier is a phone number and the step of obtaining the origin identifier comprises using caller ID to obtain the phone number.

4. The method of claim 1 wherein the communication is a network and the identifier is a network address.

5. A method for determining origin ZIP code for a postage meter, the method comprising the steps of:

receiving a communication originating from the location of the postage meter;

obtaining an origin identifier of the originating communication;

determining if the origin identifier has changed from a previous communication for the postage meter;

obtaining an address corresponding to the origin identifier when the origin identifier is different from the previous identifier obtained during the last communication for the postage meter;

obtaining five-digit ZIP code for the address; and determining if five-digit ZIP code has changed from previous ZIP code used during the last communication for the postage meter.

6. The method of claim 5 wherein the communication is a phone call and the identifier is a phone number and the step of obtaining the origin identifier comprises using caller ID to obtain the phone number.

7. The method of claim 5 wherein the communication is a network and the identifier is a network address.

8. The method of claim 5, comprising the further steps of:

requesting a new certificate based on the five-digit ZIP code when the five-digit ZIP code is different from previous call for the postage meter;

downloading the new certificate to the postage meter; and transferring postage meter register values to new post office for the new five-digit ZIP code.

9. A method for determining origin ZIP code for a postage meter, the method comprising the steps of:

receiving a call at a data center, the call originating from the location of the postage meter;

determining the identification of the postage meter and a first phone number originating the call using caller ID;

determining if the first phone number has changed from a second phone number from a previous phone call from the location of the postage meter;

obtaining an address corresponding to the first phone number when the first phone number is different from the second phone number;

obtaining a five-digit ZIP code for the address;

determining if the five-digit ZIP code has changed from a previous ZIP code used for postal accounting during previous transactions for the postage meter;

obtaining a new certificate based on the five-digit ZIP code when the five-digit ZIP code is different from the previous ZIP code;

downloading the new certificate to the postage meter; and transferring postage meter register values to a new postal account for the new certificate.

10. The method of claim 9 wherein the step of obtaining an address corresponding to the first phone number comprises the steps of:

searching an on-line phone book database for the first phone number; and reading from the on-line phone book the address corresponding to the first phone number.

11. The method of claim 9 wherein the step of obtaining an address corresponding to the first phone number comprises the step of:

requesting the address or the five-digit ZIP code from the originator of the originating phone call.

12. The method of claim 9 wherein the steps of obtaining a five-digit ZIP code for the address comprises the step of:

searching a ZIP+4 database for the address; and reading from the database the five-digit ZIP code corresponding to the address.

13. The method of claim 9 comprising the further step of:

comparing the postage meter identification with a database of lost and stolen meters to determine if the postage meter has been lost or stolen.

* * * * *